US006527133B1

(12) United States Patent
McCollum et al.

(10) Patent No.: US 6,527,133 B1
(45) Date of Patent: Mar. 4, 2003

(54) MULTIPLE LABEL LIQUID CONTAINER

(75) Inventors: Matthew Stephen McCollum, Jackson, MI (US); Patrick E. Taylor, Jackson, MI (US); Shawn R. LaRock, Manchester, MI (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

(21) Appl. No.: 09/706,302

(22) Filed: Nov. 3, 2000

(51) Int. Cl.[7] ..... B65D 90/02
(52) U.S. Cl. ..... 215/382; 220/660
(58) Field of Search ..... 215/382, 379; 220/660, 669–675, 632; D9/500, 501, 502, 531

(56) References Cited

U.S. PATENT DOCUMENTS

| | | | | |
|---|---|---|---|---|
| D200,879 | S | | 4/1965 | Randlett |
| D203,226 | S | | 12/1965 | Schnur |
| D213,763 | S | | 4/1969 | Plummer |
| 3,708,082 | A | | 1/1973 | Platte |
| D229,670 | S | | 12/1973 | Platte |
| D238,654 | S | | 2/1976 | Platte |
| 4,016,995 | A | | 4/1977 | Frazer |
| 4,046,275 | A | | 9/1977 | Virog, Jr. et al. |
| D256,664 | S | | 9/1980 | Burrington et al. |
| D265,797 | S | | 8/1982 | Platte |
| 4,372,455 | A | | 2/1983 | Cochran |
| 4,832,211 | A | | 5/1989 | Matthews et al. |
| 4,846,359 | A | | 7/1989 | Barid et al. |
| D302,946 | S | | 8/1989 | Cramer |
| D332,747 | S | | 1/1993 | Darr et al. |
| 5,318,787 | A | | 6/1994 | Brauner et al. |
| D348,612 | S | | 7/1994 | Ring |
| D360,830 | S | * | 8/1995 | Hestehave et al. ..... D9/566 |
| 5,704,506 | A | | 1/1998 | Tobias et al. |
| D391,854 | S | | 3/1998 | Ankney et al. |
| D392,188 | S | | 3/1998 | Darr et al. |
| 5,833,115 | A | | 11/1998 | Eiten |
| D415,035 | S | | 10/1999 | Ankney et al. |
| D418,423 | S | * | 1/2000 | Lauth, III et al. ..... D9/531 |
| D427,076 | S | | 6/2000 | Ankney et al. |
| D448,976 | S | * | 10/2001 | McDonough et al. ..... D7/509 |

* cited by examiner

*Primary Examiner*—Lee Young
*Assistant Examiner*—Lien Ngo
(74) *Attorney, Agent, or Firm*—Dorsey & Whitney LLP

(57) ABSTRACT

A thin-walled multi-label container generally includes side walls, a bottom, a top having a neck, a handle, a first label surface and a bumper. Corner portions interconnect adjacent side edge portions of respective side walls. A curved base portion interconnects an adjacent bottom edge portion of a respective side wall with an adjacent edge portion of the bottom. A curved crown portion interconnects an adjacent top edge portion of a respective side wall with an adjacent edge portion of the top. The handle is formed in a region extending along one of the curved corner portions within the profile of the container and provides an aperture for receiving the fingers of a user. The first label surface is located on one of the side walls. The bumper extends around the periphery of the container across each of the upstanding side walls and projects outward from each of the side walls a distance sufficient to prevent contact of the first label surface against any flat surface abutting against the container. The container also includes a downward facing shoulder located on a corner portion located intermediate the bumper and the top which defines a recessed portion of the corner portion which extends between the bumper and the shoulder. The recessed portion is adapted to receive a plastic-sleeve type label.

20 Claims, 3 Drawing Sheets

MULTIPLE LABEL LIQUID CONTAINER

BACKGROUND OF THE INVENTION

1. Field of the Invention

This invention relates to a new and improved thin-walled multi-label container, and more particularly, to a thin-walled liquid container configured to receive and protect multiple labels applied thereon.

2. Description of Related Art

Blow molded thin-walled plastic bottles are conventionally used to hold liquids and beverages, and are particularly suited to hold milk, water, and juice. For example, thin-walled light weight milk containers have been used commercially in a variety of standardized sizes including one-gallon, three-quart, half-gallon, one-quart, and other sizes. These standard size containers have a generally standardized square or rectangular shape, as is well known.

An exemplar of known thin-walled plastic bottles is U.S. Pat. No. 4,372,455 to Cochran which shows a thin-walled plastic container construction. U.S. Pat. No. 4,046,275 to Virog, Jr. et al. discloses a milk bottle having a horizontal band for stiffening the container and a volumetric insert for fine adjustments to the volume of the molded container. U.S. Pat. No. 5,704,506 discloses a container having an attached handle.

Plastic containers having a square or rectangular shape, including those disclosed above, have been found to be more suitable than other types of plastic containers for use in applications where a relatively high degree of mechanical and automated processing is involved, such as automatic filling procedures. Generally, such plastic containers have four generally flattened side walls interconnected by curved corner portions. A handle is often integrally formed on the container and constructed as to not extend beyond the perimeter of the container.

Generally such thin-walled plastic bottles are conveyed along an automatic filling line of a bottling and packaging plant and packed for shipment into a carrying case such as a milk crate. Because the handle does not extend beyond the perimeter, regardless of how the container is fed into a filling line, carrying case or the like, the container handle does not interfere with the motion of the container. Furthermore, such thin-walled plastic bottles have a high degree of standardization with respect to size and shape, as noted above, in order to facilitate motion along a filling line and placement into a carrying case.

When traveling along the filling line, a wall of one plastic bottle abuts directly against a wall of another adjacent plastic bottle. Although such contact between bottles is desirable because it serves to convey the bottles along a filling line, such contact is disadvantageous because it causes wear and other damage to any labels applied to the bottles. Such wear and other damage affects the aesthetics of the bottle which may in turn affect a consumer's decision when purchasing a plastic bottle product.

Milk and water bottles are conventionally transported from dairies and water bottling plants to retail outlets in rectangular carrying cases which are standard in much of the industry. The bodies of trucks employed to transport them and the dimensions of conveyors used to handle them are similarly standardized to conform to the standard case size.

When known thin-walled plastic bottles are filled and loaded into a standard carrying case, two or three walls of one bottle directly abut against and contact two or three other bottles. Such contact may also cause wear and other damage to any label applied to the bottles.

Known thin-walled plastic bottles have the further disadvantage of being configured to receive only one type of label. For example, a known conventional plastic bottle has a flat surface adapted to receive an adhesive label. Such known plastic bottles, however, are ill-suited for receiving a plastic-sleeve type label because the known plastic bottles lack means to prevent the plastic-sleeve label from slipping off the bottle after the label has been applied.

What is needed is an improved thin-walled plastic container which readily accepts a variety of labels and is configured to protect the labels.

SUMMARY OF THE INVENTION

In summary, a thin-walled multi-label container in accordance with the present invention generally includes side walls, a bottom, a top having a neck, a handle, one or more label surfaces and a bumper. Corner portions interconnect adjacent side edge portions of respective side walls. A curved base portion interconnects an adjacent bottom edge portion of a respective side wall with an adjacent edge portion of the bottom. A curved crown portion interconnects an adjacent top edge portion of a respective side wall with an adjacent edge portion of the top. The handle is formed in a region extending along one of the curved corner portions within the profile of the container and provides an aperture for receiving the fingers of a user. The label surfaces are located on respective side walls. The bumper extends around the periphery of the container across each of the upstanding side walls and projects outward from each of the side walls a distance sufficient to prevent contact of the label surfaces against any flat surface abutting against the container. The container also includes a downward facing shoulder located on a corner portion located intermediate the bumper and the top which defines a recessed portion of the corner portion which extends between the bumper and the shoulder. The recessed portion is adapted to receive a flexible sleeve label.

An object of the present invention is to provide a thin-walled multi-label container having a bumper configured to protect a label of the container against contact with a flat surface abutting against the container.

Thus, it is an object of the present invention to provide a thin-walled multi-label container having means to minimize and/or prevent label wear and damage due to contact with abutting surfaces, including similar abutting containers in a filling line or in a carrying case.

It is another object of the present invention to provide a thin-walled multi-label container configured to accept multiple labels of various sizes and types, including large and small adhesive, painted labels, and flexible sleeve labels.

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
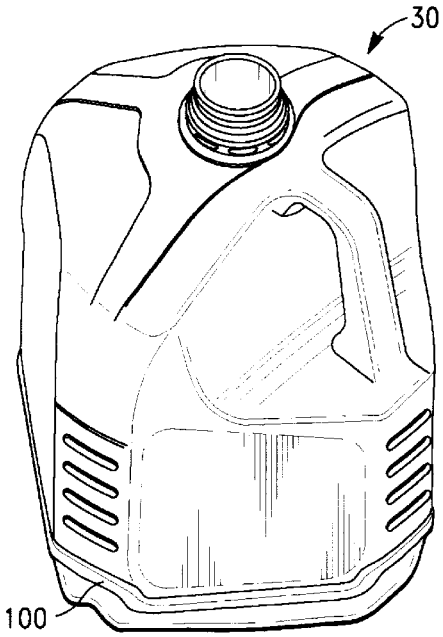
FIG. 1 is a perspective view of a multi-label liquid container in accordance with the present invention.

Turning now to the drawings, wherein like components are designated by like reference numerals throughout the various figures, attention is directed to FIG. 1. A thin-walled, multi-label container in accordance with the present invention is ideally suited for the storage and distribution of liquids, including but not limited to various beverages such as milk, juice, and bottled water. The illustrated container has volume of approximately one-gallon, however, one should appreciate that the container may have different volumes. For example, the container of the present invention can be made in three-quart, half-gallon, and one-quart sizes.

Preferably, the container has a square plan profile and generally has four flat upstanding side walls which are interconnected by four curved corner portions. One should appreciate, however, that the container is equally suitable for use with other polygonal profiles such as rectangular and triangular profiles. The container is integrally formed with a handle along one corner. In accordance with the present invention, the container further includes a bumper band and a label retention recess.

Figure 2:
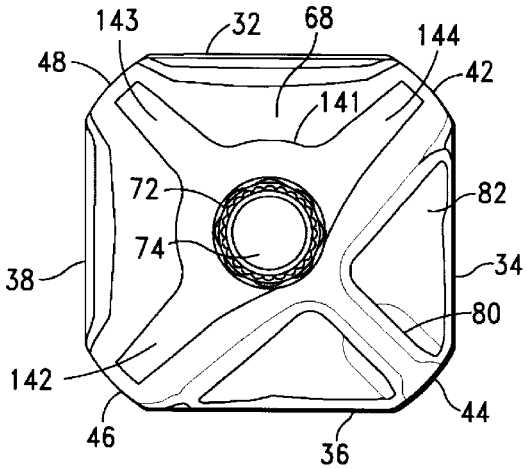
FIG. 2 is a plan view of the multi-label liquid container of FIG. 1 having first, second, third and fourth side walls.
Figure 6:
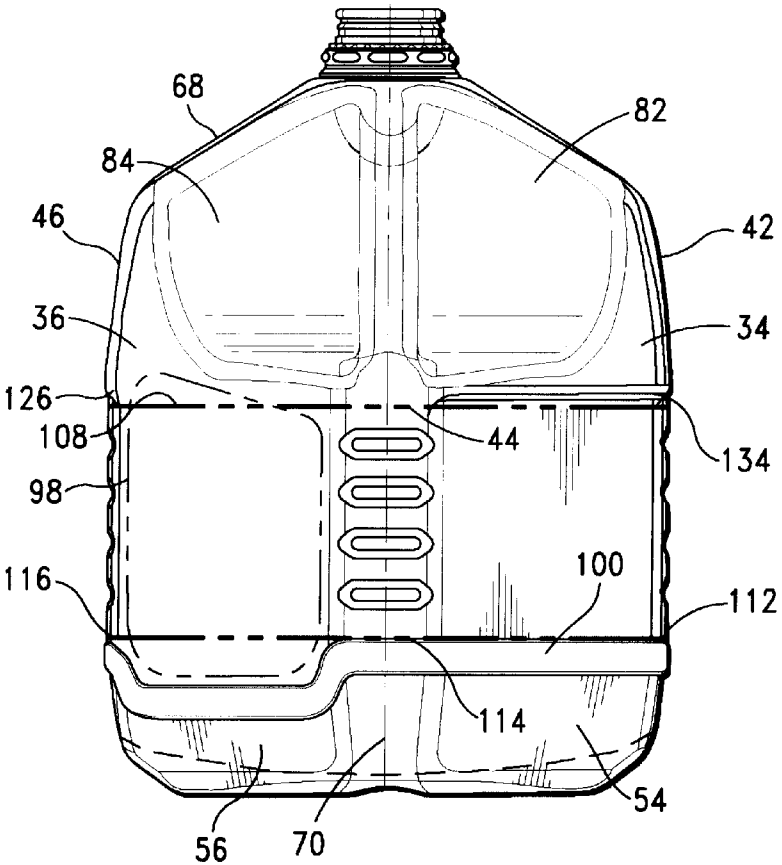
FIG. 6 is an elevational view of the second and third side walls of the container of FIG. 1.
Figure 7:
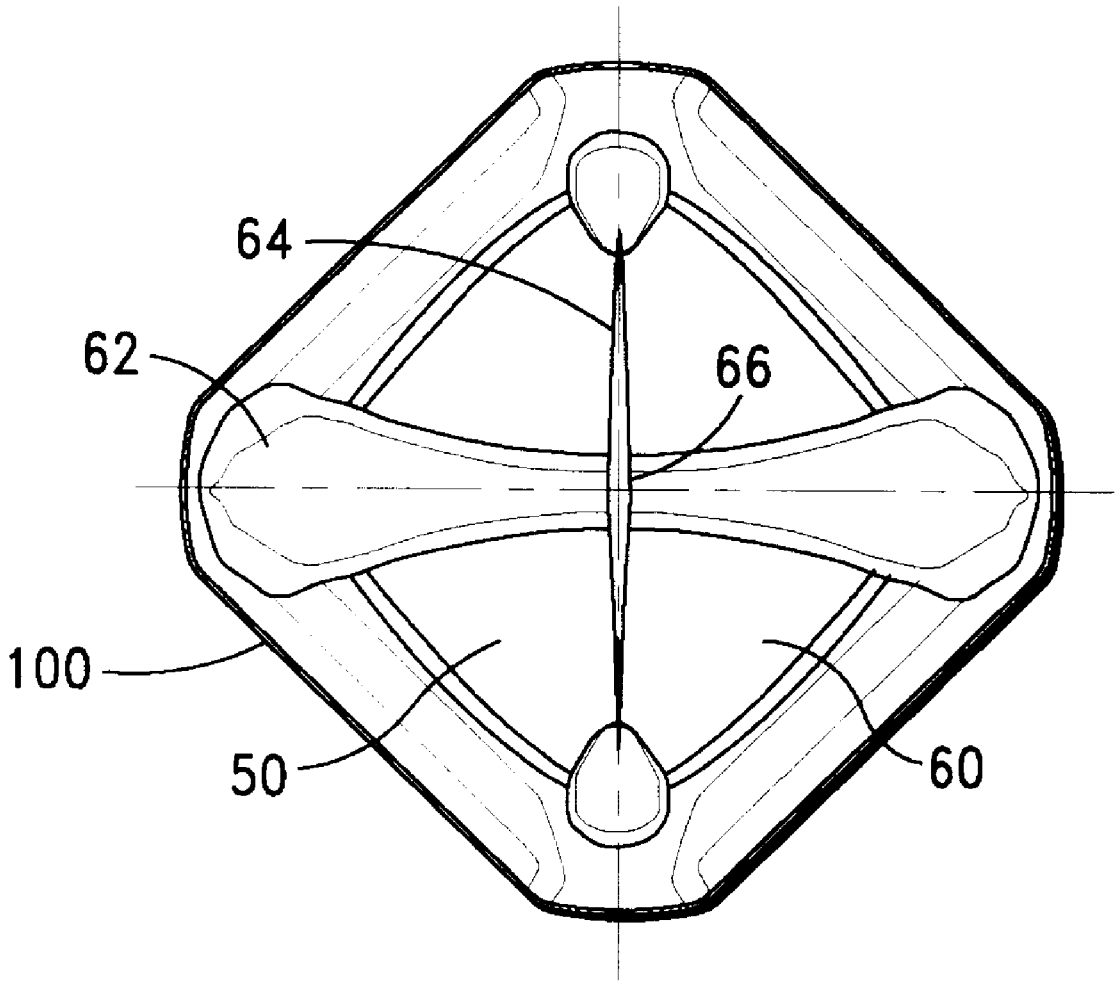
FIG. 7 is a bottom plan view of the container of FIG. 1.

Referring generally to FIGS. 2 through 7, a one-gallon size container in accordance with the present invention is designated by the numeral 30. Container 30 is blow molded and includes a one piece thin-walled construction having four generally flat side walls designated, respectively, as 32, 34, 36 and 38 and interconnected by curved corner portions designated, respectively, as 42, 44, 46 and 48. The side walls and curved corner portions together form a generally square configuration when viewed in longitudinal section or in top or bottom plan views, as is shown in FIGS. 2 and 7, respectively.

Container 30 includes a bottom 50 which is interconnected to respective side walls 32, 34, 36 and 38 by respective curved base portions 52, 54, 56, and 58. Bottom 50 has a centrally located dished or concave section 60. Bottom 50 of the container may be suitably constructed for good pinch-off characteristics during molding and also to resist deformation. For example, an angular release groove 62 tapers upwardly from a central pinch-off zone 64 at which there is formed a narrow external web 66 which intersects groove 62 as shown.

Each of side walls 32, 34, 36 and 38, and curved corner portions 42, 44, 46 and 48 are connected along their top edge portions to a domed or conically tapered top 68. The illustrated container is generally symmetrically arranged around a longitudinal axis 70. Top 68 terminates with a neck 72 having a mouth 74 which is generally symmetrically positioned about longitudinal axis 70. One should appreciate, however, that container need not be symmetrical. Instead, the container can be asymmetric having a neck and mouth which is offset from longitudinal axis 70. For example, the neck and mouth can be offset away from a handle of the container to facilitate in pouring the contents thereof.

Figure 3:
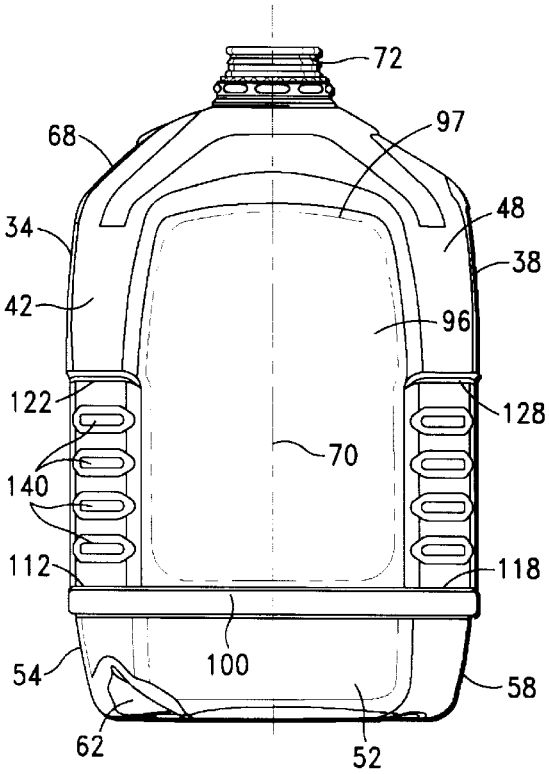
FIG. 3 is an elevational view of the first wall of the container of FIG. 1.

As shown in FIGS. 2 and 3, neck 72 is integrally connected at its base to top 68. Side wall portions of neck 72 have flanged members 76 formed thereon whose configuration depends upon the exact type of closure cap to be used with container 30. In the illustrated embodiment, flange members 76 define a tamper-evident closure engaging means, such as those disclosed by U.S. Pat. No. 4,484,687 to Bullock, III. Alternatively, the neck can including flange members which define threaded cap engaging means, such as those also disclosed by U.S. Pat. No. 5,213,224 to Luch. Preferably, lugs 78 are formed at base of neck 72 which serve as grippable elements for mechanical conveying, for example lifting the containers to facilitate packing the containers into carrying cases.

Figure 5:
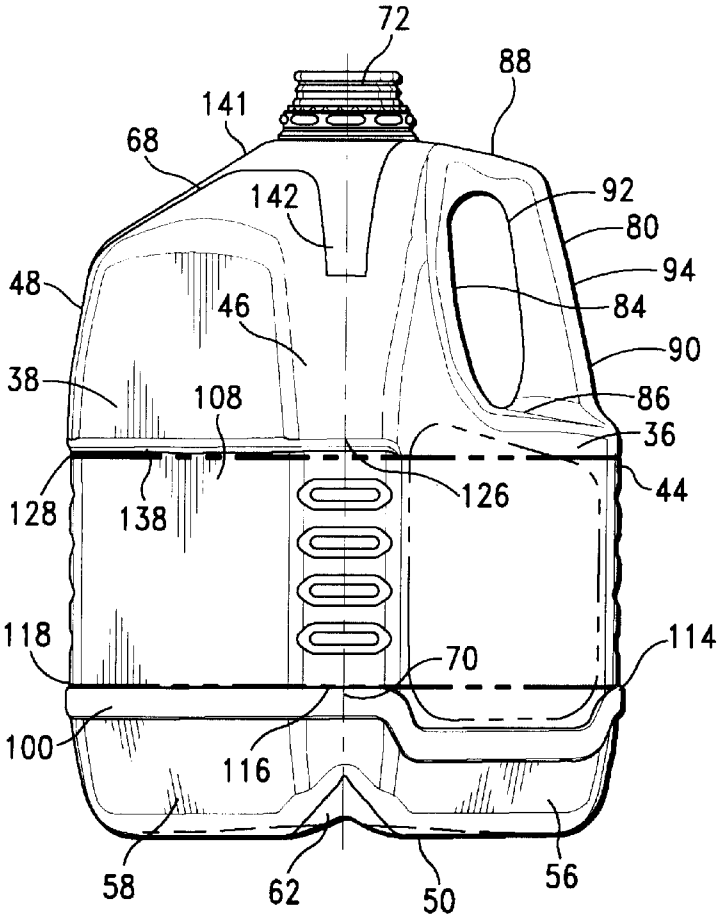
FIG. 5 is an elevational view of the third and fourth side walls of the container of FIG. 1.

Referring to FIGS. 5 and 6, one corner portion 44 is modified to incorporate a hollow handle 80 integrally formed with container 30. A chamfered surface extends between adjacent side walls 34 and 36 forming an indented handle portion 82 having upper and lower indent walls 84, 86. Upper indent wall 84 is a generally planar surface which extends between adjacent side walls 34 and 36 and along a portion of top 68. Lower indent wall 86 is a generally planar surface which is generally perpendicular to upper indent wall 84 and extends between and cuts into adjacent side walls 34 and 36.

Respective upper and lower end portions 88, 90 of the handle are integrally connected with adjoining portions of container 30 forming an aperture 92 between a central portion 94 of handle 80 and upper indent wall 84 to provide a manual gripping location for a user of container 30. Preferably, aperture 92 is smoothly curved at its top and bottom to accommodate three or four fingers of a user's hands. Also, the top portion of handle 80 preferably is curved concavely to provide a thumb-engaging portion for those users who like to squeeze the top of the upright portion of handle 80 between thumb and forefinger. Lower end portion 90 of handle 80 is connected with an upper portion of corner portion 44 and lower indent wall 86.

Figure 4:
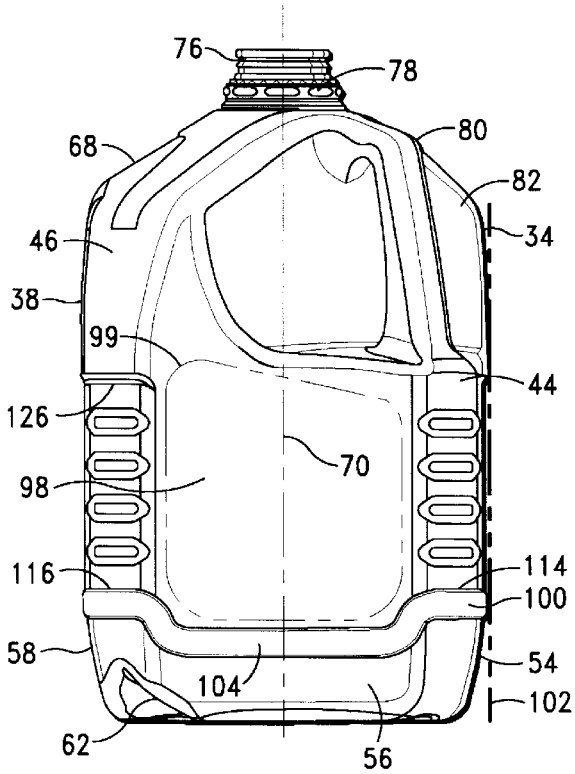
FIG. 4 is an elevational view of the third side wall of the container of FIG. 1.

As shown in FIGS. 3 and 4, container 30 is provided with one or more label surface areas 96, 98 to which one or more adhesive labels, such as labels 97 and/or 99, as shown in phantom, can be attached. Alternatively, label surface areas 96, 98 provide a surface to which identifying indicia or ornamental graphics can be applied, for example, by painting, printing, silk-screening or other suitable means. Accordingly, the contents of container 30, the source of the contents or container 30 may be conveniently identified.

As shown in FIG. 3, a first substantially planar label surface area 96 is provided on first side wall 32. Preferably, first planar label surface area 96 occupies a major portion of side wall 32 to accommodate a label 97 (shown in phantom) having a surface area more than one-half the surface area of side wall 32, and preferably 75%–100% the surface area of side wall 32. First label surface area 96 is provided in side wall 32 which is not interrupted by the chamfered surface of handle 80 and thus provides a relatively large label surface area. Preferably, first label surface area 96 occupies the majority of the surface area of first side wall 32 thus providing an area sufficient to receive a large label 97.

A second substantially planar label surface area 98 is provided on third side wall 36 opposite from first label surface area 96, as is shown in FIG. 4. Preferably, second planar label surface area 98 occupies a major portion of side wall 36 to accommodate a label 99 (shown in phantom) having a surface area more than one-half the surface area of side wall 38, and preferably 75%–100% the surface area of side wall 38. Because second label surface area 98 is located on a side wall which is interrupted by the chamfered surface of handle 80, second label surface area 98 is smaller than first label surface area 96. Similar to first label surface area 96, second label surface area 98 occupies the majority of third side wall 36 thus providing an area sufficient to receive a relatively large label 99.

One should appreciate that container 30 may include other labeling configurations. For example, the container may include two label surface areas located on adjacent side walls, thus providing two label surface areas capable of receiving either two large labels, two small labels, or one large label and one small label.

As shown in FIG. 1, container 30 further include a bumper band 100 which extends around periphery of container 30. Bumper band 100 is formed integrally with container 30 during the blow-molding process. Bumper band 100 extends substantially horizontally across each of upstanding side walls 32, 34, 36 and 38 and across interconnecting corner portions 42, 44, 46 and 48. Bumper band 100 projects outward from each of side walls 32, 34, 36 and 38 a distance that is sufficient to prevent contact of first label surface area 96 against any flat surface abutting against container 30. For example, bumper band 100 prevents the sidewall of another adjacent liquid container from contacting a label applied to first label surface area 96 when the containers move along a filling line or are packed in a carrying case. An exemplary flat surface is indicated in phantom and designated by numeral 102 in FIG. 4.

Bumper band 100 generally extends outwardly from side walls 32, 34, 36 and 38 in the range of approximately 0.020–0.100 inches, and is preferably 0.040 inches. Bumper band 100 has a width which is sufficient to provide a sufficient contact area for abutting adjacent surfaces but it is not so wide as to significantly detract from the label surface area. Preferably, bumper band 100 is approximately in the range of approximately 0.125–0.750 inches and is preferably 0.375 inches in height. As can be seen in FIG. 1, bumper band 100 does not significantly affect the appearance of the overall appearance of container 30 or its ability to be packed four, six or eight to a standard carrying case.

The illustrated bumper band 100 generally has a uniform depth and width, however, one should appreciate that other configurations can be used. For example, the bumper band can be wider as it approaches the corner portion than the band is at the center of the side walls. Alternatively, the bumper band can be wider or deeper on the larger side walls adjacent larger label surface areas in order to provide increased protection for the larger label surface areas. Alternatively, the band may be segmented instead of continuous around the entire periphery of container 30. One should also appreciate that the bumper need not be positioned at the lower edge of the side walls and instead could be provided at the middle portion or top edge of the side walls and provide a degrees of label protection.

As shown in FIG. 4, bumper band 100 preferably has an offset portion 104 located on third sidewall 36. Offset portion 104 is offset downwardly to accommodate a larger surface area but still provides protection against abutting flat surfaces. Although offset portion 104 is shown on third side wall 36, one should appreciate that an offset portion may be provided on a different side wall in addition or instead of third side wall 36. For example, the offset portion of the bumper can be provided on a side wall that is not interrupted by indented handle portion 82 thus providing an even larger label area surface.

The thin-walled multi-label container 30 according to the present invention further includes structure that is adapted to receive a flexible tubular plastic-sleeve label 108. In particular, container 30 includes an upward facing shoulder 112, 114, 116 and 118 located on each of corner portions 42, 44, 46 and 48 proximal to a respective curved base portion 52, 54, 56 and 58. Container 30 further includes a downward facing shoulder 122, 126 and 128 located on three of corner portions 42, 46 and 48 intermediate a respective upward facing shoulder 112, 116, and 118 and top 68 of container 30. Together, the shoulders define a recessed portion of each corner portion extending between the shoulders. The shoulders extend in the range of approximately 0.020–0.080 inches, and preferably 0.040 inwardly from the respective corner portions thus providing a recess that is particularly well suited to receive sleeve label 108 around the periphery of container 30. The dimensions of the recess also prevent or minimize the likelihood of plastic-sleeve label 108 from slipping off from container 30 once it has be applied to container 30. Although the illustrated embodiment does not show a downward facing shoulder on corner portion 44, one should appreciate that a similar downward facing shoulder can be provided to further promote plastic-sleeve label retention on container 30.

As shown in FIGS. 3–6, bumper band 100 extends across corner portions 42, 44, 46 and 48 and thus forms upward facing shoulders 112, 114, 116 and 118. Thus, bumper band 100 not only prevents an abutting flat surface from contacting the label surface areas but also serves as a shoulder that prevents plastic-sleeve label 108 applied to container 30 from sliding down container 30 below its intended position. In the case that bumper band 100 is continuous and encircles container 30, bumper band 100 forms a respective upward facing shoulder 112, 114, 116 and 118 on each of corner portions 42, 44, 46 and 48.

As shown in FIGS. 5 and 6, a side wall may also be provided with a downward facing shoulder. In particular, side walls 34 and 38 are each provided with downward facing wall shoulders 134 and 138 and serve the same function as downwardly facing shoulders 122, 126 and 128, namely, positioning plastic-sleeve label 108 on container 30 and preventing it from slipping off container 30. Because bumper band 100 also extends across said walls 34 and 38, the bumper band also serves as an upward facing shoulder which complements downward facing wall shoulders 134 and 138. The illustrated embodiment has a downward facing wall shoulder 134, 138 on opposing side walls 34, 38 and thus provides effective label retention. However, one should appreciate that a downward facing wall could be provided on each side wall and fall within the scope of the present invention.

As shown in FIG. 3, one or more corner ribs 140 are provided on corner portions 42, 44, 46 and 48 to provide additional structural integrity of container 30. In particular, corner ribs 140 may be horizontally extending elongated indentations that are vertically arranged along the recessed portions of corner portions 42, 44, 46 and 48 as is shown in FIGS. 3–6. One should appreciate that the ribs may have various shapes and configures. For example, the ribs may be alternatively be circular or square shaped and may be in the form of indentations, as shown in the Figures. Alternatively, the ribs can be protrusions which extend outwardly from the recess portion so long as the protrusions do not extend further out that the shoulders and negate the plastic-sleeve holding ability of the shoulders.

Container 30 is preferably molded of high density polyethylene which is conventionally used for plastic juice, milk and water containers. It is also within the scope of the invention to use other polymers such as polypropylene, polyethylene terephthalate (PET) and glycol modified polyethylene terephthalate (PET G) Once molded, any excess material or flash is trimmed from container 30. The container is decorated by various means to identify the contents of the container, the manufacturer or source of the container and/or the contents thereof. For example, an adhesive label may be applied to either the first or second label surfaces. Alternatively, identifying information or graphic ornamentation can be applied by painting or silk-screening either the first or second label surfaces. Furthermore, a plastic-sleeve label could be applied around the container instead of or in addition to labels or other ornamentation.

The container is then filled directly or some time thereafter. One should appreciate, however, that the container may be filled before, during, and/or after one or more labels are applied to the container. Certain adjustments to the mold cavity will generally be made to bring the capacity of the container to the standardized volume of the container (e.g., one-gallon, one-quart, etc.). Such volume adjustments are conventional and are accomplished by selecting and utilizing a replaceable volumetric insert or plug.

Because container 30 of the present invention has a substantially square profile, it is readily adapted for conveyance along a filling line during automated and semiautomated filling and loading operations. Container 30 is also readily adapted for storage and shipment. In particular, because container 30 is substantially square or rectangular shaped, it readily fits within standard carrying cases and refrigeration cases. For example, container 30 in accordance with the present invention is readily adapted to fit within a carrying case, such as a common a milk crate, so that four similarly shaped one-gallon containers can be fitted into the case.

Bumper band 100 effectively prevents an abutting flat surface, such as an adjacent side wall of an abutting container, from contacting label surface areas 96, 98 and the recessed sleeve label area of container 30. Because contact is minimized and/or prevented, wear and other damage to labels 97, 99 and/or 109 affixed to labels surface areas 96 and 98 and/or to sleeve label 108, respectively, is thus minimized and/or prevented.

Container 30 includes a strengthening top rib 141 located on and extending upwardly from top 68. Strengthening top rib 141 is optionally provided to improve the structural integrity and the top load strength of the container. Such a strengthening top rib is advantageous to minimize or prevent deformation of the containers in the event that containers are stacked upon one another, for example, when a plurality of containers are stacked in column three, four, or more container high.

Strengthening top rib 140 includes three strengthening rib extensions 142, 144, 146 which extend outward toward corner portions 46, 48, 42, respectively. One should appreciate that the strengthening top rib may take various forms and still fall within the scope of the present invention. For example, the strengthening top rib may have the same wall thickness as the top and or side walls of the container. Alternatively, the strengthening top rib may have a greater wall thickness than other portions of the container. One should also appreciate that strengthening top rib may include one, two, three or more strengthening rib extensions.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A blow molded plastic container comprising:

a plurality of upstanding side walls;

a plurality of corner portions interconnecting adjacent side edge portions of respective side walls;

a bottom, an adjacent edge portion of said bottom joined to an adjacent bottom edge portion of a respective side wall;

a top having a neck, an adjacent edge portion of said top joined to an adjacent top edge portion of a respective side wall;

a handle formed generally in a region extending along one of said corner portions generally within the profile of said container, said handle forming a aperture for receiving the fingers of a user;

a label surface located on at least one of said side walls; and a bumper extending around the periphery of said container across each of said upstanding side walls, said bumper projecting outward from each of said side walls a distance, said distance being sufficient to prevent contact of said label surface against any flat surface abutting against said container, wherein said bumper is offset downwardly to extend around said label surface thereby enlarging said label surface.

2. A container according to claim 1 wherein said bumper is continuous.

3. A container according to claim 1 wherein said bumper extends substantially horizontally across said side walls.

4. A container according to claim 1 wherein said second label surface is located on a side wall opposite said first label surface.

5. A blow molded plastic container comprising:

a plurality of upstanding side walls;

a bottom joined to an adjacent bottom edge portion of each said side wall;

a top having a neck, said top joined to an adjacent top edge portion of each said side wall;

a handle formed generally within the profile of said container, said handle forming a aperture for receiving the fingers of a user;

a planar label surface located on one of said side walls; and a bumper extending around the periphery of said container across each of said upstanding side walls, said bumper projecting outward from each of said side walls a distance, said distance being sufficient to prevent contact of said label surface against any flat surface abutting against said container, wherein at least one other of said side walls includes a downward facing shoulder located intermediate said bumper and said top, said shoulder defining a recessed portion of said side wall extending between said bumper and said shoulder, wherein said recessed portion is adapted for receiving a flexible-sleeve label, said planar label surface extending along the height of said one side wall from said bumper to higher than said shoulder.

6. A container according to claim 5 wherein said recessed portion of at least one said corner portion includes an inwardly directed corner rib for added structural integrity.

7. A container according to claim 1 wherein at least one of said side walls includes a planar label surface which occupies at least 75% the area of said at least one side wall.

8. A container according to claim 1 further comprising a strengthening rib located on said top adjacent said neck, said strengthening rib including a rib extension extending outwardly from said neck toward at least one corner portion.

9. A blow molded plastic container comprising:

a plurality of upstanding side walls;

a plurality of corner portions joined to adjacent side edge portions of respective side walls;

a bottom, an adjacent edge portion of said bottom joined to an adjacent bottom edge portion of a respective side wall;

a top having a neck, an adjacent edge portion of said top joined to an adjacent top edge portion of a respective side wall;

a handle formed generally in a region extending along one of said corner portions generally within the profile of said container, said handle forming a aperture for receiving the fingers of a user;

a planar label surface located on one of said side walls;

an upward facing shoulder located on at least one of said corner portions proximal a respective curved base portion; and a downward facing shoulder located on said at least one said corner portion intermediate said upward facing shoulder and said top, said shoulders defining a recessed portion of said corner portion extending therebetween, wherein said recessed portion is adapted for receiving a flexible-sleeve label, wherein said planar label surface extends along the height of said one side wall from proximal said upward facing shoulder to higher than said downward facing shoulder.

10. A container according to claim 9 further comprising a bumper extending around the periphery of said container and extending across each of said four upstanding side walls, said bumper projecting outward from each of said side walls a distance, said distance being sufficient to prevent contact of said label surface against any flat surface abutting against said container, said bumper forming said upward facing shoulder.

11. A container according to claim 9 wherein said recessed portion of at least one said corner portion includes an inwardly directed corner rib for added structural integrity.

12. A container according to claim 9 wherein at least one said corner portion includes an inwardly directed corner rib for added structural integrity.

13. A container according to claim 9 wherein at least one of said side walls includes a planar label surface which occupies at least 75% the area of said at least one side wall.

14. A container according to claim 8 comprising three strengthening ribs extending outwardly from said top, each strengthening rib extending outwardly toward a respective one of said corner portions.

15. A container according to claim 1 wherein at least one said corner portion includes an inwardly directed corner rib for added structural integrity.

16. A container according to claim 5 wherein said bumper is continuous.

17. A container according to claim 5 wherein said bumper extends substantially horizontally across said side walls.

18. A container according to claim 5 wherein said second label surface is located on a side wall opposite said first label surface.

19. A container according to claim 5 further comprising a strengthening rib located on said top adjacent said neck, said strengthening rib including a rib extension extending outwardly from said neck toward at least one corner portion.

20. A container according to claim 19 comprising three strengthening ribs extending outwardly from said top, each strengthening rib extending outwardly toward a respective one of said corner portions.

* * * * *

UNITED STATES PATENT AND TRADEMARK OFFICE

CERTIFICATE OF CORRECTION

PATENT NO. : 6,527,133 B1
DATED : March 4, 2003
INVENTOR(S) : McCollum et al.

It is certified that error appears in the above-identified patent and that said Letters Patent is hereby corrected as shown below:

Title page, Item [54] and Column 1, line 1,
Change the title to read as follows: -- MULTIPLE LABEL CONTAINER --

Signed and Sealed this

Fifteenth Day of July, 2003

JAMES E. ROGAN
*Director of the United States Patent and Trademark Office*